US012151909B2

(12) United States Patent
Oshida

(10) Patent No.: US 12,151,909 B2
(45) Date of Patent: Nov. 26, 2024

(54) SHEET SUPPLY DEVICE

(71) Applicant: TOSHIBA TEC KABUSHIKI KAISHA, Tokyo (JP)

(72) Inventor: Katsuya Oshida, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 197 days.

(21) Appl. No.: 17/894,190

(22) Filed: Aug. 24, 2022

(65) Prior Publication Data

US 2024/0067469 A1 Feb. 29, 2024

(51) Int. Cl.

*B65H 1/26* (2006.01)
*B65H 1/04* (2006.01)
*B65H 3/06* (2006.01)

(52) U.S. Cl.

CPC ..... *B65H 1/266* (2013.01); *B65H 1/04* (2013.01); *B65H 3/06* (2013.01); *B65H 2402/32* (2013.01); *B65H 2511/20* (2013.01); *B65H 2701/1131* (2013.01); *B65H 2801/06* (2013.01)

(58) Field of Classification Search

CPC ..... B65H 1/266; B65H 1/04; B65H 2405/31; B65H 2405/60; B65H 2402/32; G03G 15/6502

See application file for complete search history.

(56) References Cited

U.S. PATENT DOCUMENTS

2016/0231692 A1 8/2016 Hayayumi
2016/0334745 A1* 11/2016 Kwon ..... G03G 15/6502
2022/0317616 A1* 10/2022 Shiraishi ..... B65H 1/266

FOREIGN PATENT DOCUMENTS

JP 2008-050081 3/2008
JP 2009-202962 9/2009

* cited by examiner

*Primary Examiner* — Luis A Gonzalez

(74) *Attorney, Agent, or Firm* — Amin, Turocy & Watson, LLP

(57) ABSTRACT

A sheet supply device in an embodiment includes a cassette, a housing, a drawing-in device, a roller, and a guide member. The housing supports the cassette to be movable in a first direction. The drawing-in device draws the cassette into the housing. The roller is supported by one of the cassette and the housing. The guide member is supported by another of the cassette and the housing. The guide member includes a groove having the first direction as a longitudinal direction and having a third direction orthogonal to the first direction and the second direction as a width direction. The roller is disposed in a first portion in the first direction of the groove in a state in which the cassette is housed in the housing.

17 Claims, 6 Drawing Sheets

SHEET SUPPLY DEVICE

FIELD

Embodiments described herein relate generally to a sheet supply device.

BACKGROUND

An image forming apparatus disposed in a workplace forms an image on a sheet. The image forming apparatus includes a sheet supply device that supplies the sheet. The sheet supply device includes a cassette and a housing. The cassette is capable of storing sheets. The housing supports the cassette to be movable in a first direction. The cassette moves in the first direction to be housed in the housing. There has been a demand for a sheet supply device that can reduce a load at a cassette housing time when the cassette is housed in the housing.

DETAILED DESCRIPTION

Figure 1:
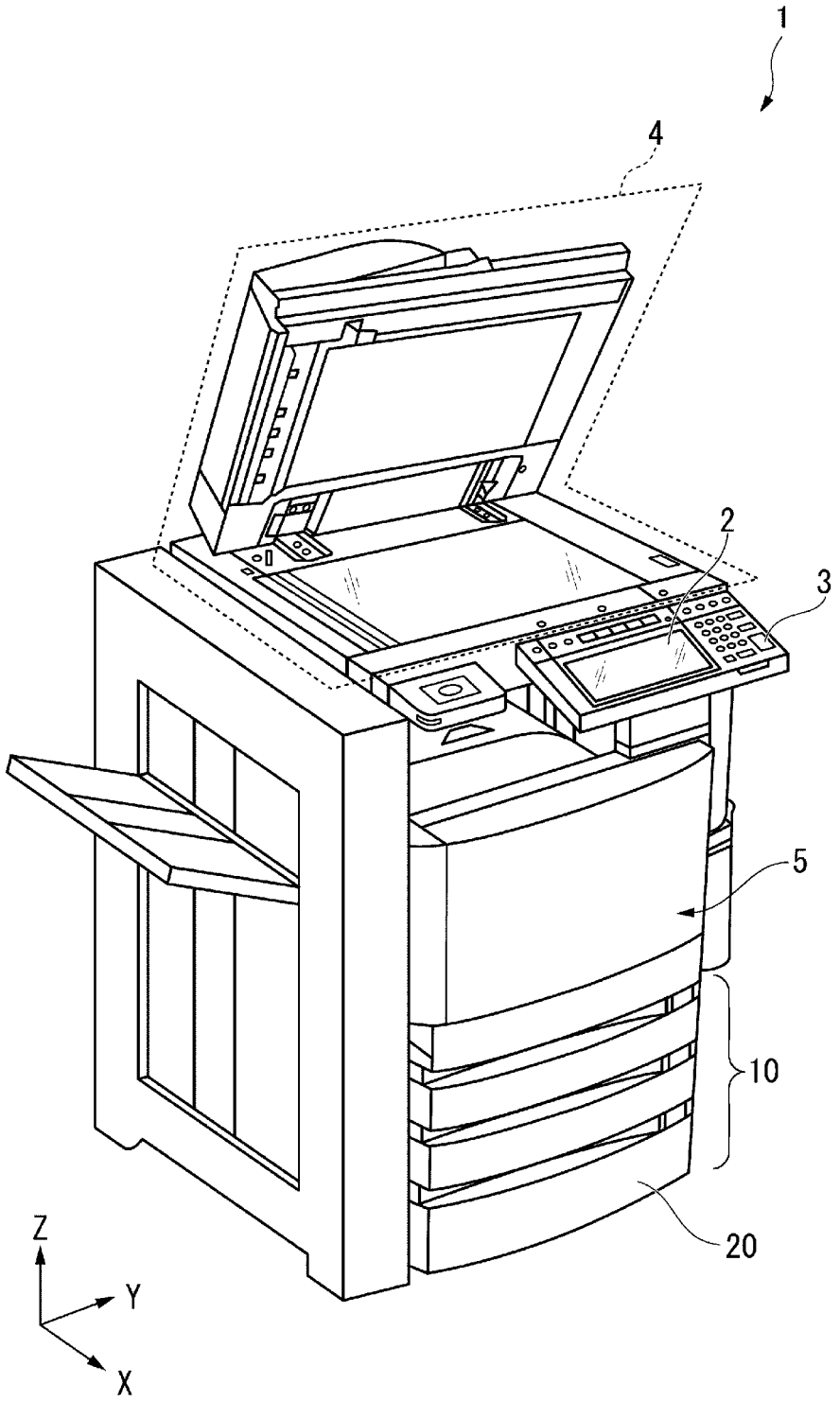
FIG. 1 is a perspective view of an image forming apparatus.

A sheet supply device in an embodiment includes a cassette, a housing, a drawing-in device, a roller, and a guide member. The cassette is capable of storing sheets. The housing supports the cassette to be movable in a first direction. The drawing-in device draws the cassette into the housing. The roller is supported by one of the cassette and the housing. The roller is capable of rotating around a rotation axis parallel to a second direction orthogonal to the first direction. The guide member is supported by another of the cassette and the housing. The guide member includes a groove having the first direction as a longitudinal direction and having a third direction orthogonal to the first direction and the second direction as a width direction. An inner surface in the third direction of the groove is capable of coming into contact with an outer circumferential surface of the roller. The roller is disposed in a first portion in the first direction of the groove in a state in which the cassette is housed in the housing. If the cassette moves in the third direction according to the drawing-in of the cassette in the first direction by the drawing-in device, a first inner surface on a first side in the third direction of the groove in contact with the roller extends in parallel to the first direction from the first portion. If the drawing-in device starts to draw in the cassette, the roller is disposed in a second portion in the first direction of the groove. A second inner surface on a second side, which is an opposite side of the first side, in the third direction in the second portion of the groove is disposed further on the second side in the third direction than the second inner surface in the first portion.

The sheet supply device in the embodiment is explained below with reference to the drawings.

FIG. 1 is a perspective view of an image forming apparatus 1. In this application, a Z direction, an X direction, and a Y direction of an orthogonal coordinate system and a 0 direction are defined as follows. The Z direction (a second direction) is the vertical direction and a +Z direction is the upward direction. The X direction and the Y direction are the horizontal direction. The X direction (a first direction) is the front-rear direction of the image forming apparatus 1. A +X direction is the forward direction. The Y direction (a third direction) is the left-right direction of the image forming apparatus 1. A +Y direction (a second side in the third direction) is a direction in which a sheet stored in a cassette 20 is supplied. A −Y direction (a first side in the third direction) is the opposite direction of the +Y direction. The θ direction is a circumferential direction in the Z direction. A +θ direction is a rotating direction of a right-handed screw advancing in a −Z direction.

The image forming apparatus 1 disposed in a workplace forms an image on a sheet. The image forming apparatus 1 is, for example, a multi function printer (MFP) or a copying machine. The image forming apparatus 1 may subject the image formed on the sheet to image processing. Examples of the image processing performed using the image forming apparatus 1 include processing for, for example, heating an image formed by decoloring toner to erase the image.

The image forming apparatus 1 includes a display 2, a control panel unit 3, an image reading unit 4, an image forming unit 5, and a sheet supply device 10.

The display 2 and the control panel unit 3 are used by a user to perform operation input for causing the image forming apparatus 1 to operate. The display 2 displays operation content performed by the user and a message to the user.

The image reading unit 4 reads a document and forms an image signal of an image to be formed by the image forming unit 5.

The image forming unit 5 forms an image on a sheet based on the operation input or a signal from the outside.

The sheet supply device (a paper feeding device) 10 is disposed in a lower part of the image forming apparatus 1. The sheet supply device 10 supplies a sheet to the image forming unit 5.

Figure 2:
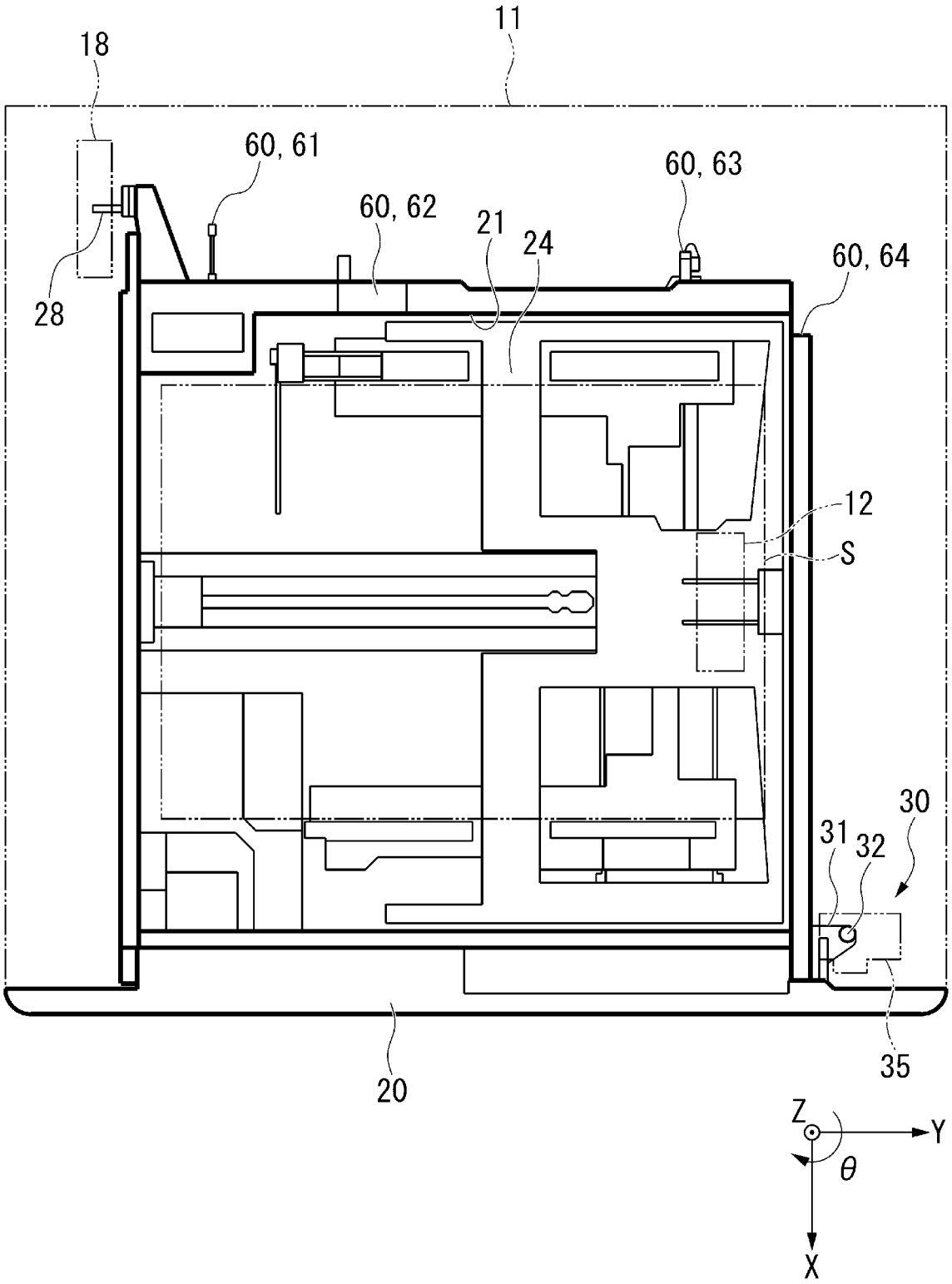
FIG. 2 is a plan view of a sheet supply device in an embodiment.

FIG. 2 is a plan view of the sheet supply device 10 in the embodiment. The sheet supply device 10 includes a cassette 20 and a housing (a frame) 11.

The cassette 20 is formed in a box shape, the upper surface of which is opened. The cassette 20 includes a sheet storing unit 21 capable of storing sheets S. The sheets S are placed on a tray 24 of the sheet storing unit 21. The sheets S are picked up one by one by a pickup roller 12 and supplied to the image forming unit 5. The sheet S is supplied in the +Y direction from the sheet storing unit 21.

The housing 11 supports the cassette 20 to be movable in the X direction. The cassette 20 moves in the +X direction to be drawn out from the housing 11. The cassette 20 moves in the −X direction to be housed in the housing 11. The user of the image forming apparatus 1 draws out the cassette 20 from the housing 11 and fills the sheets S in the cassette 20. The user houses the cassette 20 in the housing 11 and causes the image forming apparatus 1 to start image formation.

The sheet supply device 10 includes a drawing-in device 18 for drawing the cassette 20 into the housing 11. The drawing-in device 18 is set in a corner of the −X direction and the −Y direction of the housing 11. The cassette 20 includes a pin 28 in the corner of the −X direction and the −Y direction. The pin 28 projects in the −Y direction from the cassette 20.

In housing the cassette 20, the user of the image forming apparatus 1 pushes in the cassette 20 in the −X direction. If the cassette 20 moves to near the end portion in the −X direction, the pin 28 enters the drawing-in device 18. The drawing-in device 18 draws in the pin 28 in the −X direction making use of a restoration force of an urging member. Consequently, the cassette 20 is housed in the housing 11. The drawing-in device 18 supports housing work for the cassette 20 by the user. The drawing-in device 18 houses the cassette 20 in a predetermined position of the housing 11. Consequently, supply accuracy of the sheet S is improved.

The cassette 20 includes contact sections 60. The contact sections 60 come into contact with the housing 11 according to the drawing-in of the cassette 20 by the drawing-in device 18. The contact sections 60 include an attenuation damper 61, a sheet size detecting mechanism 62, a tray moving mechanism 63, and a pickup roller moving mechanism (a paper feeding module) 64. The attenuation damper 61 attenuates vibration (relaxes a shock) at a housing time of the cassette 20. The sheet size detecting mechanism 62 detects a size of the sheets S stored in the cassette 20. The tray moving mechanism 63 raises the tray 24 on which the sheets S are placed. The pickup roller moving mechanism 64 lowers the pickup roller 12, which picks up the sheets S one by one from the cassette 20, and brings the pickup roller 12 into contact with the sheet S.

The contact sections 60 are disposed side by side on the end face in the −X direction of the cassette 20. The pickup roller moving mechanism 64, the tray moving mechanism 63, the sheet size detecting mechanism 62, and the attenuation damper 61 are disposed in this order from the +Y direction to the −Y direction. The drawing-in device 18 is disposed in the −Y direction of the cassette 20. The drawing-in device 18 is disposed in the −Y direction of the contact sections 60.

The drawing-in device 18 causes a force in the −X direction to act on the cassette 20 and draws in the cassette 20 in the −X direction. The housing 11 causes a force in the +X direction in the opposite direction of the drawing-in direction of the cassette 20 to act on the contact sections 60. The housing 11 causes the force in the +X direction to act on the cassette 20 via the contact sections 60.

The force acting on the contact sections 60 from the housing 11 increases in the order of the tray moving mechanism 63, the sheet size detecting mechanism 62, the attenuation damper 61, and the pickup roller moving mechanism 64. The sheet size detecting mechanism 62, the attenuation damper 61, and the pickup roller moving mechanism 64 receive a large force from the housing 11 because the sheet size detecting mechanism 62, the attenuation damper 61, and the pickup roller moving mechanism 64 make use of elastic forces of coil springs. The force acting on the attenuation damper 61 from the housing 11 greatly fluctuates because the force is proportional to a square of moving speed of the cassette 20.

If the cassette 20 is drawn into the housing 11, a force in the −X direction acts on the cassette 20 from the drawing-in device 18 and a force in the +X direction acts on the cassette 20 from the housing 11 and the contact sections 60. The drawing-in device 18 is disposed in the −Y direction of the contact sections 60. Consequently, if the cassette 20 is drawn into the housing 11, moment in the +θ direction acts on the cassette 20.

The sheet supply device 10 includes a guide mechanism 30. The guide mechanism 30 prevents the cassette 20 from turning in the +θ direction and guides the cassette 20 to move in the −X direction.

The guide mechanism 30 is disposed in a corner of the +X direction and the +Y direction of the cassette 20 and on the outer side of the sheet storing unit 21. The guide mechanism 30 includes a roller 32 and a guide member 35.

Figure 3:
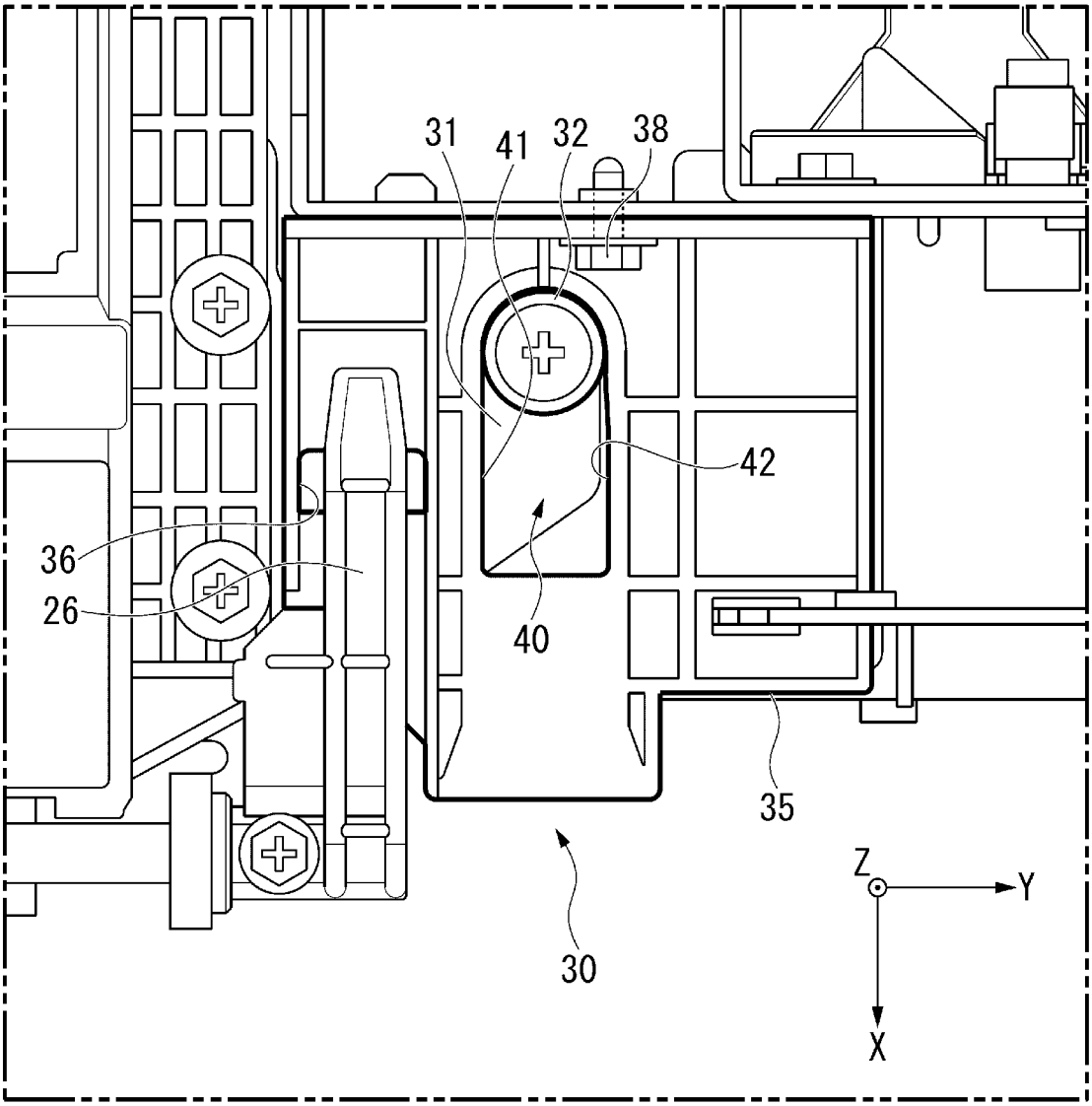
FIG. 3 is a plan view of a guide mechanism.
Figure 4:
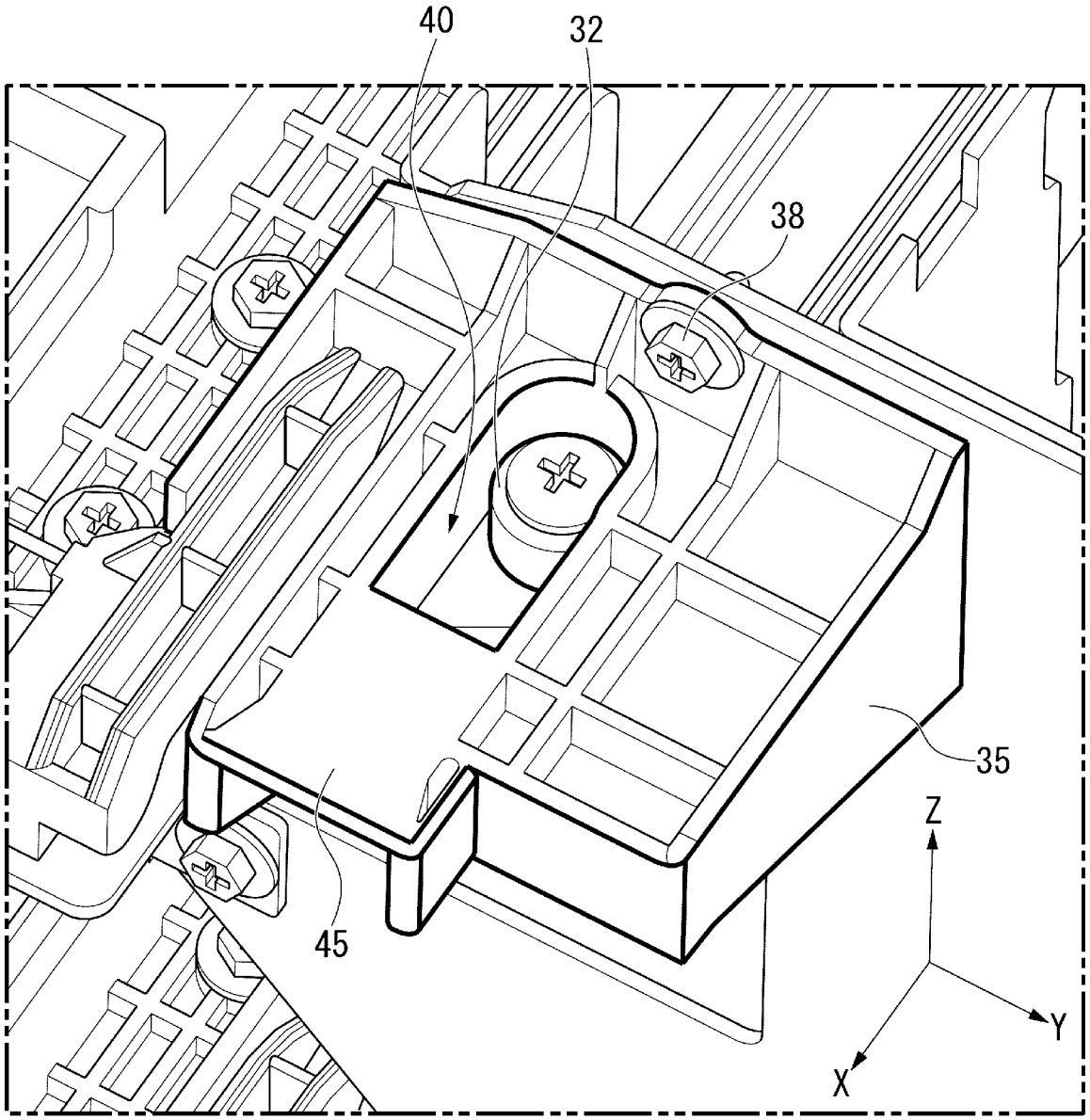
FIG. 4 is a perspective view of the guide mechanism.
Figure 5:
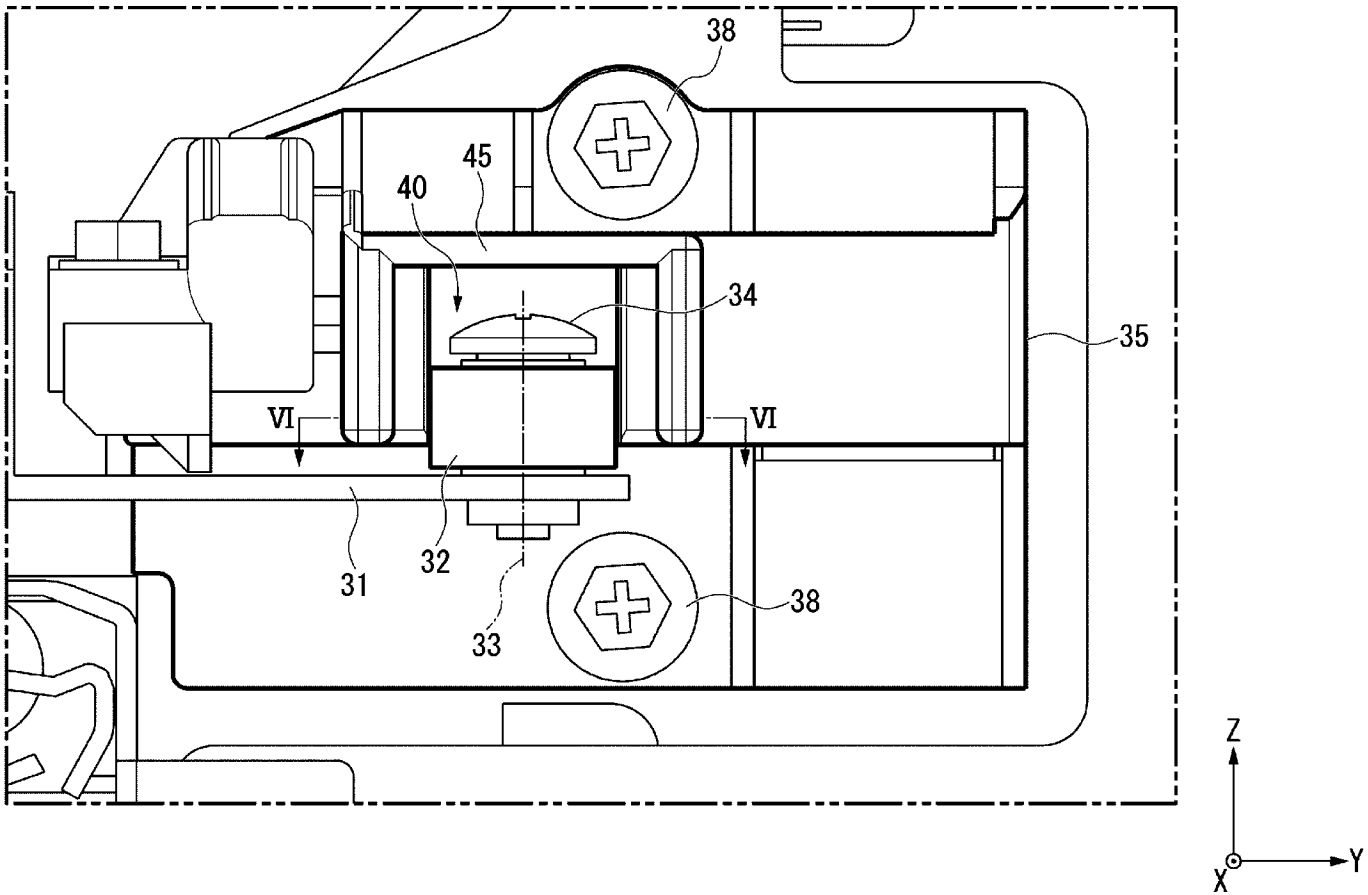
FIG. 5 is a front view of the guide mechanism.

FIG. 3 is a plan view of the guide mechanism 30. FIG. 4 is a perspective view of the guide mechanism 30. FIG. 5 is a front view of the guide mechanism 30.

The roller 32 has a cylindrical shape. The roller 32 is supported by the cassette 20. As illustrated in FIG. 5, the cassette 20 includes a supporting plate 31 parallel to an XY plane. A shaft 34 is set in the +Z direction of the supporting plate 31. The center axis of the shaft 34 is parallel to the Z direction. The roller 32 is disposed coaxially with the shaft 34. The roller 32 is capable of rotating around a rotation axis 33 parallel to the Z direction.

The guide member 35 is formed by a resin material or the like. The guide member 35 is supported by the housing 11. The guide member 35 is fixed to the housing 11 by a fixing member 38 such as a bolt and a nut.

As illustrated in FIG. 3, the guide member 35 includes a hook hole 36. A cassette hook 26 engages in the hook hole 36. The cassette hook 26 is associated with a handle on the front surface of the cassette 20. If the cassette 20 is housed in the housing 11, the user of the image forming apparatus 1 takes the user's hand off the handle. The cassette hook 26 lowers and engages in the hook hole 36. Consequently, the cassette 20 is locked in a housed state. Since the hook hole 36 is formed in the guide member 35, the number of components is prevented from increasing.

As illustrated in FIG. 4, the guide member 35 is formed in a substantially U-shape in a plan view. The guide member 35 includes a groove 40. The groove 40 has the X direction and a longitudinal direction and has the Y direction as a width direction. The groove 40 includes an opening at the end portion in the +X direction. The roller 32 enters the inner side of the groove 40 through the opening of the groove 40. The guide member 35 includes a connecting section 45 that connects both the sides in the Y direction of the groove 40. The connecting section 45 is formed at the end portion in the +Z direction of the groove 40 and allows the entry of the roller 32. The connecting section 45 is formed at least at the end portion in the +X direction of the groove 40 and suppresses deformation near the opening of the groove 40.

As illustrated in FIG. 5, the groove 40 is formed in the +Z direction of the supporting plate 31 that supports the roller 32. At least a part of the roller 32 is disposed on the inner side of the groove 40. For example, a part in the +Z direction of the roller 32 and a part in the −Z direction of the groove 40 are disposed to overlap in the Z direction. As illustrated in FIG. 3, the inner surface of the groove 40 is parallel to the Z direction and is capable of coming into contact with the outer circumferential surface of the roller 32. The inner surface in the −X direction of the groove 40 has a cylindrical surface shape conforming to the outer circumferential surface of the roller 32. A first inner surface 41 in the −Y direction and a second inner surface 42 in the +Y direction of the groove 40 have a plane shape.

If the cassette 20 is housed in the housing 11, the cassette 20 moves in the −X direction. The roller 32 supported by the cassette 20 enters the groove 40 of the guide member 35 supported by the housing 11. The roller 32 enters the inner side of the groove 40 from the opening at the end portion in the +X direction of the groove 40. After the roller 32 enters the groove 40, the drawing-in device 18 starts to draw in the cassette 20. At a point in time of completion of the drawing-in of the cassette 20, the roller 32 is disposed near the end portion in the −X direction of the groove 40.

Figure 6:
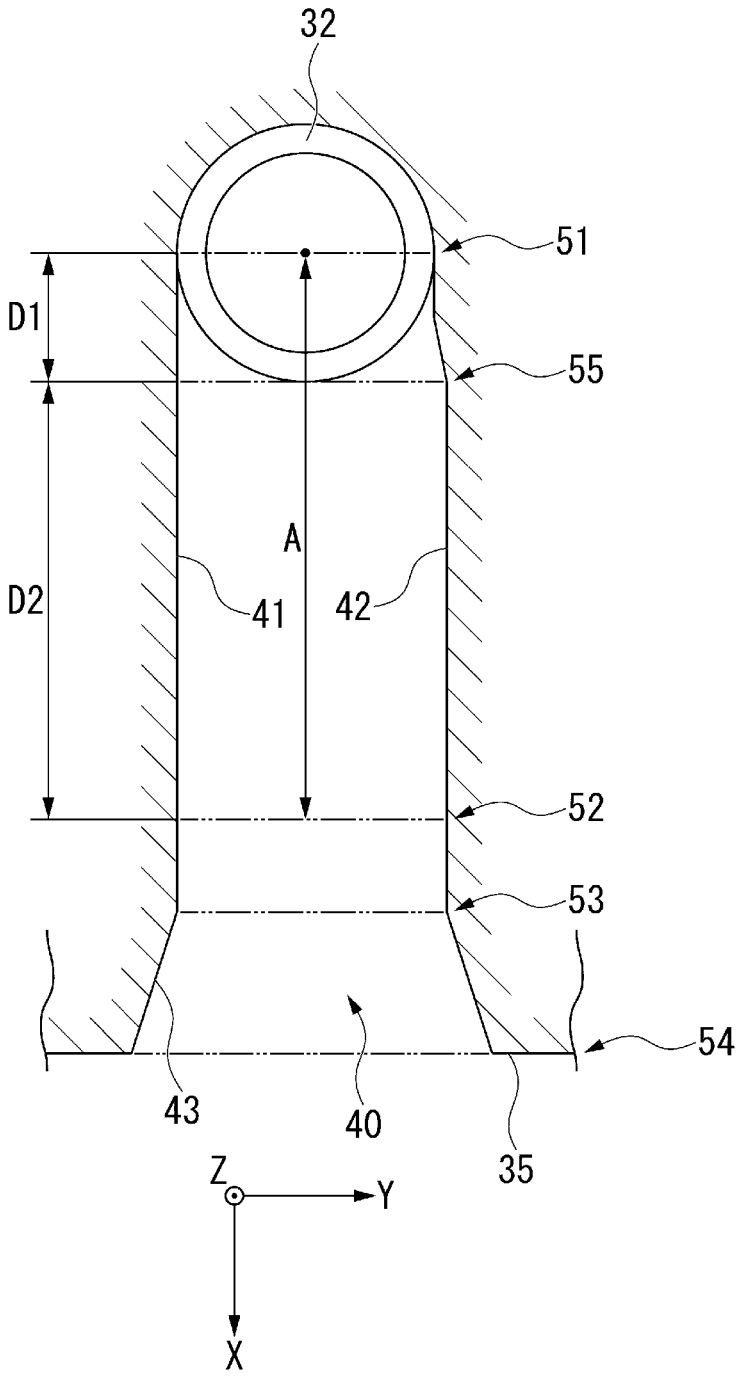
FIG. 6 is a sectional view taken along a VI-VI line in FIG. 5.

FIG. 6 is a sectional view taken along a VI-VI line in FIG. 5.

In a state in which the cassette 20 is housed in the housing 11, the roller 32 is disposed in a first portion 51 in the X direction of the groove 40. The first portion 51 is the vicinity of the end portion in the −X direction of the groove 40.

If the drawing-in device 18 starts to draw in the cassette 20, the roller 32 is disposed in a second portion 52 in the X direction of the groove 40. The second portion 52 is a position deeper in the −X direction from the opening at the end portion in the +X direction of the groove 40. A section from the second portion 52 to the first portion 51 in the X direction of the groove 40 is represented as an A section. If the drawing-in device 18 draws in the cassette 20, the roller 32 is located in the A section of the groove 40.

As illustrated in FIG. 2, if the drawing-in device 18 draws in the cassette 20 in the −X direction, moment in the +θ direction acts on the cassette 20. At this time, the cassette 20 moves in the −Y direction in the position of the guide mechanism 30. If the cassette 20 moves in the Y direction, a load in housing the cassette 20 increases.

If the cassette 20 moves in the −Y direction, the roller 32 supported by the cassette 20 comes into contact with the first inner surface 41 in the −Y direction of the groove 40 illustrated in FIG. 6.

The first inner surface 41 in the −Y direction of the groove 40 extends in the +X direction in parallel to the X direction from the first portion 51. The first inner surface 41 of the groove 40 comes into contact with the outer circumferential surface of the roller 32 and restricts movement of the roller 32 in the −Y direction. Movement of the cassette 20, which supports the roller 32, in the −Y direction is restricted. The roller 32 is capable of moving in the −X direction while rotating. Sliding resistance between the roller 32 and the groove 40 is reduced. Consequently, the load in housing the cassette 20 is reduced. According to the reduction in the load, a drawing-in force of the drawing-in device 18 can be set small. If the cassette 20 is drawn out, the cassette 20 can be drawn out with a small force resisting the drawing-in force of the drawing-in device 18.

The second inner surface 42 in the +Y direction in the second portion 52 of the groove 40 is disposed further in the +Y direction than the second inner surface 42 in the first portion 51. The width in the Y direction of the groove 40 in the first portion 51 is equivalent to the diameter of the roller 32. If the roller 32 is disposed in the first portion 51 at the completion time of the drawing-in of the cassette 20 by the drawing-in device 18, the cassette 20 is positioned in the Y direction with respect to the housing 11. The width in the Y direction of the groove 40 in the second portion 52 is larger than the diameter of the roller 32. Even if the roller 32 irregularly moves in the +Y direction at a start time of the drawing-in of the cassette 20 by the drawing-in device 18, the roller 32 less easily comes into contact with the second inner surface 42. Consequently, the load in housing the cassette 20 is reduced.

The groove 40 extends to the opposite side of the first portion 51 across the second portion 52 in the X direction. The groove 40 includes a third portion 53 in the +X direction of the second portion 52. The first inner surface 41 and the second inner surface 42 between the second portion 52 and the third portion 53 are parallel to the X direction. The movement of the roller 32 in the Y direction is restricted in the same manner from before the start to the start time of the drawing-in of the cassette 20 by the drawing-in device 18. Therefore, the cassette 20 is smoothly started to be drawn in by the drawing-in device 18.

The groove 40 includes a fourth portion 54 at the end portion on the opposite side of the first portion 51 across the second portion 52 in the X direction. The fourth portion 54 is present in the +X direction of the third portion 53. The fourth portion 54 is the end portion in the +X direction of the groove 40. The groove 40 includes a widened section 43 increased in the width in the Y direction from the third portion 53 to the fourth portion 54. The inner surface of the widened section 43 is a plane but may be a curved surface. Since an opening width of the end portion in the +X direction of the groove 40 is large, the roller 32 easily enters the groove 40. Since the roller 32 is guided to the second portion 52 by the widened section 43, the load in housing the cassette 20 is reduced.

The groove 40 includes a fifth portion 55 between the first portion 51 and the second portion 52 in the X direction. A first distance D1 between the first portion 51 and the fifth portion 55 in the X direction is shorter than a second distance D2 between the fifth portion 55 and the second portion 52. The fifth portion 55 is present near the first portion 51. The second inner surface 42 between the fifth portion 55 and the second portion 52 is parallel to the X direction. The width in the Y direction of the groove 40 between the fifth portion 55 and the second portion 52 is larger than the diameter of the roller 32. Even if the roller 32 irregularly moves in the +Y direction while the cassette 20 is drawn in by the drawing-in device 18, the roller 32 less easily comes into contact with the second inner surface 42. The width in the Y direction of the groove 40 decreases from the fifth portion 55 to the first portion 51. The roller 32 is positioned in the Y direction immediately before the completion of the drawing-in of the cassette 20 by the drawing-in device 18. Consequently, the load in housing the cassette 20 is reduced.

The guide member 35 includes the connecting section 45 that connects both the sides in the Y direction of the groove 40. Deformation of the groove 40 is suppressed by the connecting section 45. Accuracy of movement restriction in the Y direction for the roller 32 by the groove 40 is improved. Consequently, the load in housing the cassette 20 is reduced.

The cassette 20 includes the contact sections 60 that come into contact with the housing 11 according to the drawing-in of the cassette 20 by the drawing-in device 18. The contact sections 60 receive a force in the opposite direction of the drawing-in direction of the cassette 20 from the housing 11. The drawing-in device 18 is disposed in the −Y direction of the contact sections 60.

If the drawing-in device 18 draws in the cassette 20 in the −X direction, moment in the +θ direction acts on the cassette 20. The cassette 20 moves in the −Y direction in the position of the guide mechanism 30. The roller 32 supported by the cassette 20 comes into contact with the first inner surface 41 in the −Y direction of the groove 40. The first inner surface 41 in the −Y direction of the groove 40 extends in the +X direction in parallel to the X direction from the first portion 51. Movement of the cassette 20 in the −Y direction is restricted. Consequently, the load in housing the cassette 20 is reduced.

One of the contact sections 60 is the pickup roller moving mechanism 64 that brings the pickup roller 12, which picks up the sheets S one by one from the cassette 20, into contact with the sheet S.

One of the contact sections 60 is the attenuation damper 61 that attenuates vibration at the housing time of the cassette 20.

One of the contact sections 60 is the sheet size detecting mechanism 62 that detects a size of the sheets S stored in the cassette 20.

One of the contact sections 60 is the tray moving mechanism 63 that raises the tray 24 on which the sheets S are placed.

The contact sections 60 receive a force in the opposite direction of the drawing-in direction of the cassette 20 from the housing 11. In this case as well, in the sheet supply device 10 in the embodiment, the load in housing the cassette 20 is reduced.

In the embodiment, the roller 32 is supported by the cassette 20 and the guide member 35 is supported by the housing 11. In this case, if the cassette 20 moves in the −Y direction, the roller 32 comes into contact with the inner surface in the −Y direction of the groove 40 of the guide member 35. In contrast, the roller 32 may be supported by the housing 11 and the guide member 35 may be supported by the cassette 20. In this case, If the cassette 20 moves in the −Y direction, the inner surface in the +Y direction of the groove 40 of the guide member 35 comes into contact with the roller 32. The groove 40 in this case is obtained by inverting the groove 40 in the embodiment by 180° in the θ direction.

In the embodiment, the drawing-in device 18 is disposed in the −Y direction of the contact sections 60. In this case, if the cassette 20 is drawn in, the roller 32 comes into contact with the inner surface in the −Y direction of the groove 40. In contrast, the drawing-in device 18 may be disposed in the +Y direction of the contact sections 60. In this case, if the cassette 20 is drawn in, the roller 32 comes into contact with the inner surface in the +Y direction of the groove 40. The groove 40 in this case is obtained by mirror-inverting the groove 40 in the embodiment with an XZ plane passing the center in the Y direction as a plane of symmetry.

According to the at least one embodiment explained above, the first inner surface 41 in the −Y direction of the groove 40 extends in parallel to the X direction from the first portion 51. The second inner surface 42 in the +Y direction in the second portion 52 of the groove 40 is disposed further in the +Y direction than the second inner surface 42 in the first portion 51. Consequently, the load in housing the cassette 20 can be reduced.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A sheet supply device, comprising:

a cassette configured to store sheets;

a housing configured to support the cassette so as to be movable in a first direction;

a drawing-in device configured to draw the cassette into the housing;

a roller supported by one of the cassette and the housing and configured to rotate around a rotation axis parallel to a second direction orthogonal to the first direction; and a guide member supported by another of the cassette and the housing and including a groove having the first direction as a longitudinal direction and having a third direction orthogonal to the first direction and the second direction as a width direction, wherein an inner surface in the third direction of the groove is configured to contact an outer circumferential surface of the roller, the roller is disposed in a first portion in the first direction of the groove in a state in which the cassette is housed in the housing, when the cassette moves in the third direction according to the drawing-in of the cassette in the first direction by the drawing-in device, a first inner surface on a first side in the third direction of the groove in contact with the roller extends in parallel to the first direction from the first portion, when the drawing-in device starts to draw in the cassette, the roller is disposed in a second portion in the first direction of the groove, a second inner surface on a second side, which is an opposite side of the first side, in the third direction in the second portion of the groove is disposed further on the second side in the third direction than the second inner surface in the first portion, the groove extends to an opposite side of the first portion across the second portion in the first direction, the groove includes a third portion on the opposite side of the first portion across the second portion in the first direction, and the first inner surface and the second inner surface between the second portion and the third portion are parallel to the first direction.

2. The sheet supply device according to claim 1, wherein the groove includes a fourth portion at an end portion on the opposite side of the first portion across the second portion in the first direction, and the groove includes a widened section increasing in width in the third direction from the third portion to the fourth portion.

3. The sheet supply device according to claim 1, wherein the groove includes a fifth portion between the first portion and the second portion in the first direction, a first distance between the first portion and the fifth portion in the first direction is shorter than a second distance between the fifth portion and the second portion, and the second inner surface between the fifth portion and the second portion is parallel to the first direction.

4. The sheet supply device according to claim 1, further comprising a connecting section that connects the first side and the second side in the third direction of the groove.

5. The sheet supply device according to claim 1, wherein the cassette includes a contact section configured to come into contact with the housing according to the drawing-in of the cassette by the drawing-in device and receive a force in an opposite direction of a drawing-in direction of the cassette from the housing, and the drawing-in device is disposed on one side in the third direction of the contact section.

6. The sheet supply device according to claim 5, wherein the contact section is configured to bring a pickup roller, which picks up the sheets from the cassette one by one, into contact with a sheet of the sheets.

7. The sheet supply device according to claim 5, wherein the contact section is an attenuation damper configured to attenuate vibration at a housing time of the cassette.

8. The sheet supply device according to claim 5, wherein the contact section is configured to detect a size of the sheets stored in the cassette.

9. The sheet supply device according to claim 5, wherein the contact section is configured to raise a tray on which the sheets are placed.

10. An image forming apparatus comprising the sheet supply device according to claim 1.

11. A sheet supply method, comprising:

drawing a cassette configured to store sheets movable in a first direction into a housing;

rotating a roller supported by one of the cassette and the housing around a rotation axis parallel to a second direction orthogonal to the first direction;

contacting an outer circumferential surface of the roller by an inner surface in a third direction of a groove of a guide member supported by another of the cassette and the housing, the groove having the first direction as a longitudinal direction and having the third direction orthogonal to the first direction and the second direction as a width direction, the roller being disposed in a first portion in the first direction of the groove in a state in which the cassette is housed in the housing;

when the cassette moves in the third direction according to the drawing-in of the cassette in the first direction by a drawing-in device, extending a first inner surface on a first side in the third direction of the groove in contact with the roller in parallel to the first direction from the first portion;

when the drawing-in device starts to draw in the cassette, disposing the roller in a second portion in the first direction of the groove; and disposing the groove in the third direction in the second portion further on a second side in the third direction than a second inner surface in the first portion, wherein, the groove extends to an opposite side of the first portion across the second portion in the first direction, the groove includes a third portion on the opposite side of the first portion across the second portion in the first direction, and the first inner surface and the second inner surface between the second portion and the third portion are parallel to the first direction.

12. The sheet supply method according to claim 11, further comprising:

a connecting section that connects the first side and the second side in the third direction of the groove.

13. The sheet supply method according to claim 11, further comprising:

contacting a contact section of the cassette with the housing according to the drawing-in of the cassette by the drawing-in device and receiving a force in an opposite direction of a drawing-in direction of the cassette from the housing, wherein the drawing-in device is disposed on one side in the third direction of the contact section.

14. The sheet supply method according to claim 13, further comprising:

bringing a pickup roller, which picks up the sheets from the cassette one by one, into contact with a sheet of the sheets.

15. The sheet supply method according to claim 13, further comprising:

attenuating vibration at a housing time of the cassette.

16. The sheet supply method according to claim 13, further comprising:

detecting a size of the sheets stored in the cassette.

17. The sheet supply method according to claim 13, further comprising:

raising a tray on which the sheets are placed.

* * * * *